US005388566A

United States Patent [19]

Smith et al.

[11] Patent Number: 5,388,566

[45] Date of Patent: Feb. 14, 1995

[54] GAS FIRES

[75] Inventors: Martin L. Smith, Birmingham; Paul A. Gillam, West Midlands, both of England

[73] Assignee: Valor Limited, Birminham, England

[21] Appl. No.: 208,203

[22] Filed: Mar. 10, 1994

Related U.S. Application Data

[63] Continuation of Ser. No. 910,887, Jul. 10, 1992, abandoned.

[30] Foreign Application Priority Data

Jul. 12, 1991 [GB] United Kingdom ..... 9115165

[51] Int. Cl.[6] ..... F24C 3/00

[52] U.S. Cl. ..... 126/512; 126/307 A; 126/83; 431/125

[58] Field of Search ..... 431/125; 126/92 R, 92 AC, 126/92 B, 92 A, 92 C, 512, 552, 307 A, 83

[56] References Cited

U.S. PATENT DOCUMENTS

| | | | |
|---|---|---|---|
| 852,679 | 5/1907 | Richards | 431/125 |
| 1,017,751 | 2/1912 | Hansen | 126/512 |
| 2,660,159 | 11/1953 | Hughes | 126/307 A X |
| 3,254,642 | 6/1966 | Tuttle | 126/512 X |
| 3,291,116 | 12/1966 | Brooks | 126/92 R |
| 3,362,395 | 1/1968 | Peterson | 126/92 R |
| 3,536,060 | 10/1970 | Block | 126/307 A |
| 4,971,030 | 11/1990 | Thow et al. | 126/92 AC X |
| 4,976,253 | 12/1990 | Beal et al. | 126/512 |
| 4,992,041 | 2/1991 | Kewish et al. | 126/92 R X |
| 5,026,579 | 6/1991 | Thow | 126/92 AC |
| 5,069,200 | 12/1991 | Thow et al. | 126/512 |
| 5,081,981 | 1/1992 | Beal | 126/512 X |
| 5,114,336 | 5/1992 | Karabin et al. | 431/125 |

FOREIGN PATENT DOCUMENTS

| | | | |
|---|---|---|---|
| 2477681 | 9/1981 | France | 126/552 |
| 2577660 | 8/1986 | France | 126/552 |
| 188179 | 11/1922 | United Kingdom | 126/92 AC |
| 909978 | 11/1962 | United Kingdom | 126/552 |
| 1488479 | 10/1977 | United Kingdom | 431/125 |
| 2203532 | 10/1988 | United Kingdom | 126/92 B |
| 2208703 | 4/1989 | United Kingdom | 126/92 R |

*Primary Examiner*—Carl D. Price

*Attorney, Agent, or Firm*—Spencer, Frank & Schneider

[57] ABSTRACT

A simulated solid fuel effect gas fire comprising two elongate simulated solid fuel elements in the form of logs, with a partially aerated gas burner arranged in front of and below each log with respect to the front of the fire. Thus, in use, the flames from the burners engage a lower front portion of the logs, the flames then passing around the front of the logs. By this arrangement the lower front regions of the logs are heated to glow as radiants and the flames subsequently lick around the front of the logs as yellow flames, in accord with the visual effect of a real fire, complete combustion having been attained in the ambient atmosphere in front of the logs to thus form the yellow flames. By the provision of nodules by virtue of a bark pattern on the upper front portion of the logs, the flames heat the nodules to red heat and enhance both the radiant heat derived from the fire and the visual effect of the fire.

30 Claims, 5 Drawing Sheets

GAS FIRES

This application is a continuation of application Ser. No. 07/910,887, filed Jul. 10, 1992, abandoned.

BACKGROUND OF THE INVENTION

1. Field of the Invention

The present invention relates to a gas fire.

More particularly the present invention relates to a gas fire of the type which includes an aerated gas burner arranged so that the flames of the burner play around simulated solid fuel elements in the form of, for example, logs made of a ceramic material.

2. Description of the Related Art

Certain known gas fires of this type utilise an aerated gas burner which is located beneath a bed of simulated solid fuel elements, the flames of the burner heating the simulated solid fuel bed so that it glows red hot and radiates an amount of heat, a few flames passing between the simulated solid fuel elements to extend upwards and add realism to the simulated solid fuel effect gas fire. However, by heating the simulated solid fuel bed from underneath, the heated simulated solid fuel elements tend to radiate an amount of heat back downwards and/or upwards rather than out of the front of the fire to heat the surrounding environment. Also, to provide for added realism by providing yellow flames between the simulated solid fuel elements, neat gas burners are provided in addition to the aerated gas burners. However the flames from such neat gas burners can and do provide for the deposition of soot wherever the flames contact.

An aim of the present invention is to provide a visually realistic simulated solid fuel effect gas fire wherein a larger proportion of the heat produced by a gas burner is radiated out of the front of the fire than in previous constructions.

SUMMARY OF THE INVENTION

According to the present invention there is provided a simulated solid fuel effect gas fire comprising a simulated solid fuel element with a partially aerated gas burner arranged in front of and below the simulated solid fuel element with respect to the front of the fire, so that, in use, the flames from the burner engage a lower front portion of the simulated solid fuel element, the flames then passing around the front of the simulated solid fuel element.

By virtue of the construction of the present invention the front portion of the simulated solid fuel effect element, e.g. a ceramic log, coal or coke, is primarily heated by the flames from the burner so that heat is primarily radiated from the simulated solid fuel element out of the front of the fire, i.e. in the desired direction to heat the surrounding environment.

Further the localised heating of the said lower front portion of the simulated solid fuel element, which portion is preferably planar and angled with the flames, induces secondary combustion which improves the heating of the simulated solid fuel element and thus the radiant output after the initial warm up period, secondary air for this secondary combustion being introduced from around the burner and below the simulated solid fuel element. The localised heating created by the secondary combustion causes the partially combusted gases to accelerate upwardly in front of and around the front portion of the simulated solid fuel element, which front portion is preferably curved. Combustion takes place in a controlled air flow environment created by the configuration of the combustion space, flue and heat exchanger, and by limiting the available space in the region of the lower front portion of the simulated solid fuel element the supply of secondary air is regulated to ensure that tertiary combustion i.e. complete combustion, occurs in front of the curved section of the simulated solid fuel element resulting in yellow flames. The regulated supply of secondary air combining with the upwards acceleration of hot gases result in the yellow flame tertiary combustion assuming the dancing flame effect of a real solid fuel fire. Regulated secondary air supply may be ensured by either a front air guide bar located in front of the simulated solid fuel element and made of metal or a ceramic material, or by a further simulated solid fuel element located in front of said burner. Further, by designing the burner as an elongate member with a relatively small transverse cross section, this burner design can also be a contributory factor in obtaining the desired air flow.

To enhance the radiant heat effect, protruding nodules which may take the form of a bark pattern, are preferably provided on the curved upper front section of the simulated solid fuel element. These nodules are impinged upon by the upwardly moving hot gases so that they are heated and glow red to give further radiant heat and add to the visual effect.

The construction of the present invention thus provides a simulated solid fuel element fire wherein a partially aerated burner both heats the lower front portion of a simulated solid fuel element to provide for forwardly directed radiant heat at a maximised level due to secondary combustion, and provides realistic yellow dancing flames, the radiant glow at the lower front portion of the simulated fuel element together with the yellow dancing flames providing a very realistic simulation of an actual solid fuel fire. Also, when nodules are provided on the curved upper front section of the simulated solid fuel element, these nodules will be heated to red heat and thus enhance both the radiant heat derived and the visual effect.

Prior art constructions of simulated solid fuel effect gas fires have required two types of gas burners to achieve the desired visual effect, a neat gas burner to provide realistic yellow flames, and an aerated gas burner which in certain constructions had to produce an excess of heat to provide for the required radiant heat of the fire and the required visual radiant effect. Such fires provide too much heat when the visual effect is required, and are thus expensive to operate and are also dirty due to the soot produced by the neat gas yellow flames. In contrast the construction of the present invention requires solely a partially aerated burner to efficiently provide both heat at the desired level and the desired visual effect, with the dancing yellow flames being clean as they are the result of the tertiary, i.e. complete, combustion. The present invention thus allows efficient heat output at a comfortable level in conjunction with the visual appeal of a solid fuel fire, efficient combustion across a range of input settings allowing a user to enjoy a variety of heat outputs, as desired, and visual appeal. As a result of this construction the formation of undesirable carbon usually associated with gas appliances attempting to replicate solid fuel burning is eliminated. Further NOX (Nitric oxide —NO, and Nitrogen Dioxide $NO_2$) emissions are at levels far lower than are normal for a gas heating appliance. However, the control of air flow in the region of the simulated fuel bed, i.e. in the combustion chamber, is critical to the attainment of the desired optimum glow, shape, positioning and coloration of the flames at the rated gas/air input. Also, the combustion performance itself, i.e. low CO, NOX and carbon formation itself, are dependent on these flames.

In a preferred embodiment of the present invention two elongate burners, i.e. aerated gas burners, which comprise an elongate arrangement of burner ports, are located across the fuel bed region of the simulated solid fuel effect gas fire, the burners being located substantially parallel to each other at spaced apart locations, with one burner to the rear of the other and at a higher position. Three simulated solid fuel elements are preferably provided, each being preferably in the form of an elongate log made of ceramic material. Two of the logs are supported, preferably at each end, by brackets, substantially parallel to each other, and to the elongate burners, with one log being supported between the two burners, and another log being to the rear of the rear burner. The third log is shorter in length than the two parallel logs and locates diagonally across the middle region of the two parallel logs. The two parallel logs, like the burners, are arranged step-wise and the rearmost burner is obscured from view from the front of the fire by the foremost parallel log, the front burner being obscured by a metal air guide member with a decorative bar preferably mounted on top of the guide member. In use, yellow flames resulting from the front burner lick around the front portion of the front log and yellow flames resulting from the rear burner lick around the front of the rear log, the logs acting as forwardly directed radiants with the yellow flames licking realistically around, between and above the logs.

Preferably the elongate burners are carried in a burner module which includes a base panel, side and rear panels, with brackets for the logs being provided on the side panels. Preferably the base panel is inclined upwardly, rearwardly of the fire to optimise air entrainment to the burners and convection air flow beneath the base panel to a heat exchanger. The module forms the lower part of the fuel bed region of the fire and preferably includes all of the gas controls. By merely disconnecting the gas supply, the module may thus be removable from the remainder of the fire, to facilitate service and repair. This modular construction also facilitates assembly during initial manufacture, and is applicable to other types of gas fire.

Both in the gas fire of the present invention and in other types of gas fire, the burners may be advantageously supported in cantilever fashion. To explain, one end region of each burner may be fixedly supported in the fire and be connected to a gas/air mix supply, with the other end region of each burner being a freely axially slidable fit in an aperture provided in a bracket or other support of the fire. In this way, the burners may be easily installed by sliding said other end region into said aperture and securing said one end region as appropriate. The reverse provides for easy removal for repair or replacement. Manufacturing tolerances are therefore not critical with regard to length and in the event of longitudinal burner expansion due to the heat, the burners can expand into their respective supporting apertures.

Both in the gas fire of the present invention and in other types of simulated solid fuel effect gas fire when combustion gases are fed away from the simulated fuel bed via one or more ports in the upper region of the rear wall of the fire, the performance and aesthetics of the fire may be improved by providing an angled heat deflector above the simulated solid fuel bed of the gas fire, the heat deflector being a generally rectangular member formed by two planar sections angled with respect to each other, which sections are located across the width of the fuel bed and angled downwardly from their front to rear edges taken with respect to the front and rear of the simulated solid fuel bed. Preferably the angled heat deflector is located in front of the single port or each of the the ports which usually lead to a convection air heat exchanger before connecting with a flue. Thus the frontal aspect of the fire is aesthetically improved. Also, the positioning of the angled deflector reduces turbulence in the hot combustion gases and facilitates passage of the combustion gases to the ports. Preferably the angled heat deflector is constructed as a black body with attendant advantages vis-a-vis heat absorption and radiation. Alternatively the heat deflector could be reflective.

Further, both in the gas fire of the present invention and in other types of simulated solid fuel effect gas fire where combustion gases are fed away from the simulated fuel bed via one or more ports which lead to a flue via a down draught diverter, the down draught diverter may be constructed on the top of the gas fire. The down draught diverter decouples the flue from the region of the simulated fuel bed, i.e. the combustion chamber, and isolates the combustion chamber from changes in the flue pull and maintains equilibrium in the air flow through the combustion chamber and flue. The down draught diverter is constructed as a chamber covering the top of the fire, the chamber being small in height as compared to its area and venting through a narrow elongate slot across the top region of the front of the fire. To the rear of the chamber and in its middle region a vertical passage interconnects the ports with said chamber. In front of the passage a wall which is generally U-shaped in plan is located in the chamber and a flue connects with the chamber through the upper wall of the chamber between the arms of the generally U-shaped wall. Further angled, i.e. generally L-shaped in plan, walls are located in the chamber on either side of the generally U-shaped wall to deflect gases issuing from the passage and passing around the generally U-shaped wall, back towards the centre of the chamber and thus towards the flue. These angled walls enhance the through flow of gases to the flue, reducing the possibility of pockets of gas collecting in corners of the chamber. A further guide wall is preferably also provided in the chamber in the middle of the front region of the chamber, to thus further enhance the through flow of gases to the flue, preventing any such combustion gases from issuing through the narrow elongate slot.

The front of the fire constructed according to the present invention is preferably closed by a transparent glass plate. Also, slots or any other desired configuration opening may be provided in the side panels of the body of the fire, to allow for part of the initially cool convection air to be drawn through the slots to cool the outer surface of the fire. This is important when the fire is installed in a wooden enclosure when an additional baffle kit is fitted to the body of the fire.

BRIEF DESCRIPTION OF THE DRAWINGS

The present invention will now be further described, by way of example, with reference to the accompanying drawings, in which.

DETAILED DESCRIPTION OF THE PREFERRED EMBODIMENTS

Figure 1:
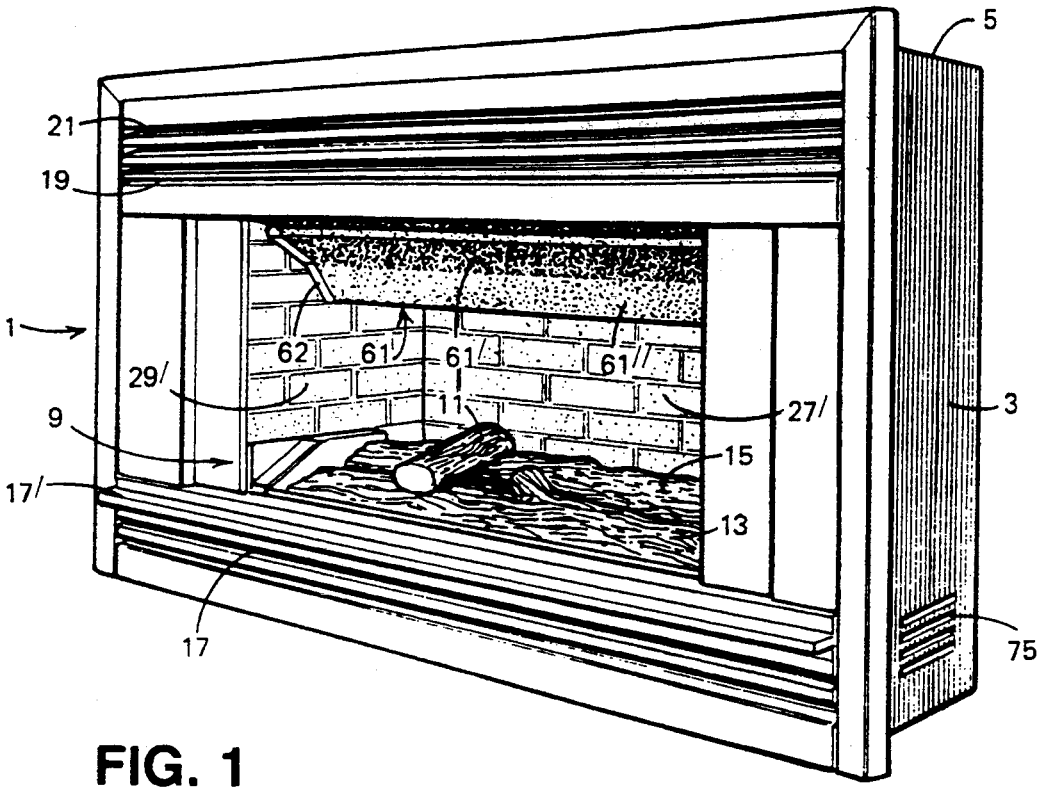
FIG. 1 is a perspective view of a preferred embodiment of gas fire constructed according to the present invention.

The preferred embodiment of the present invention illustrated in the accompanying drawings is a simulated solid fuel effect gas fire. The gas fire has a main body generally designated 1, which has planar, rectangular side panels 3 and a top panel 5 from the rear region of which a flue spigot 7 projects upwardly. The front of the fire has a simulated solid fuel effect bed 9 comprised of three generally elongate simulated logs 11,13,15 which are made of a ceramic material. Two of the simulated logs, 13,15 are arranged substantially parallel to each other, across the bed 9, and step-wise front-to-rear of the bed with the rearmost log 15 being in the highest position. The third log 11 is shorter and arranged diagonally across the middle region of the two substantially parallel logs 13, 15. Below the simulated solid fuel effect bed 9 at the front of the fire is an inlet grid 17 for convection air and for air for the burners, and above the bed 9 at the front of the fire is a convection air outlet 19 with a down draught diverter outlet 21 being located immediately thereabove at the top of the front of the fire. A motorised fan 18 is provided to enhance the convection air flow, if desired, between inlet grid 17 and outlet 19. The front of the fire is closed by a transparent glass plate 22. To comply with hearth temperature requirements an additional apron 17' is situated immediately above the inlet grid 17.

Figure 3:
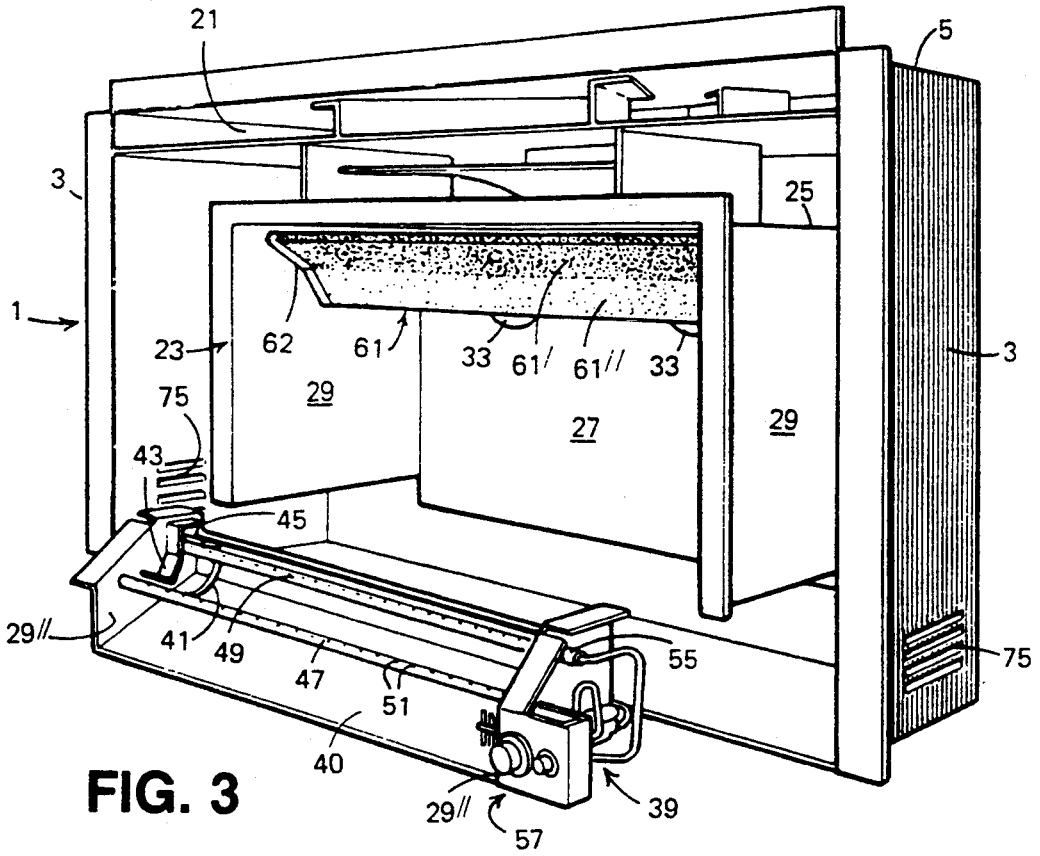
FIG. 3 is a perspective view of the fire shown in FIG. 1 with the front of the fire removed and the burner module partially removed.
Figure 2:
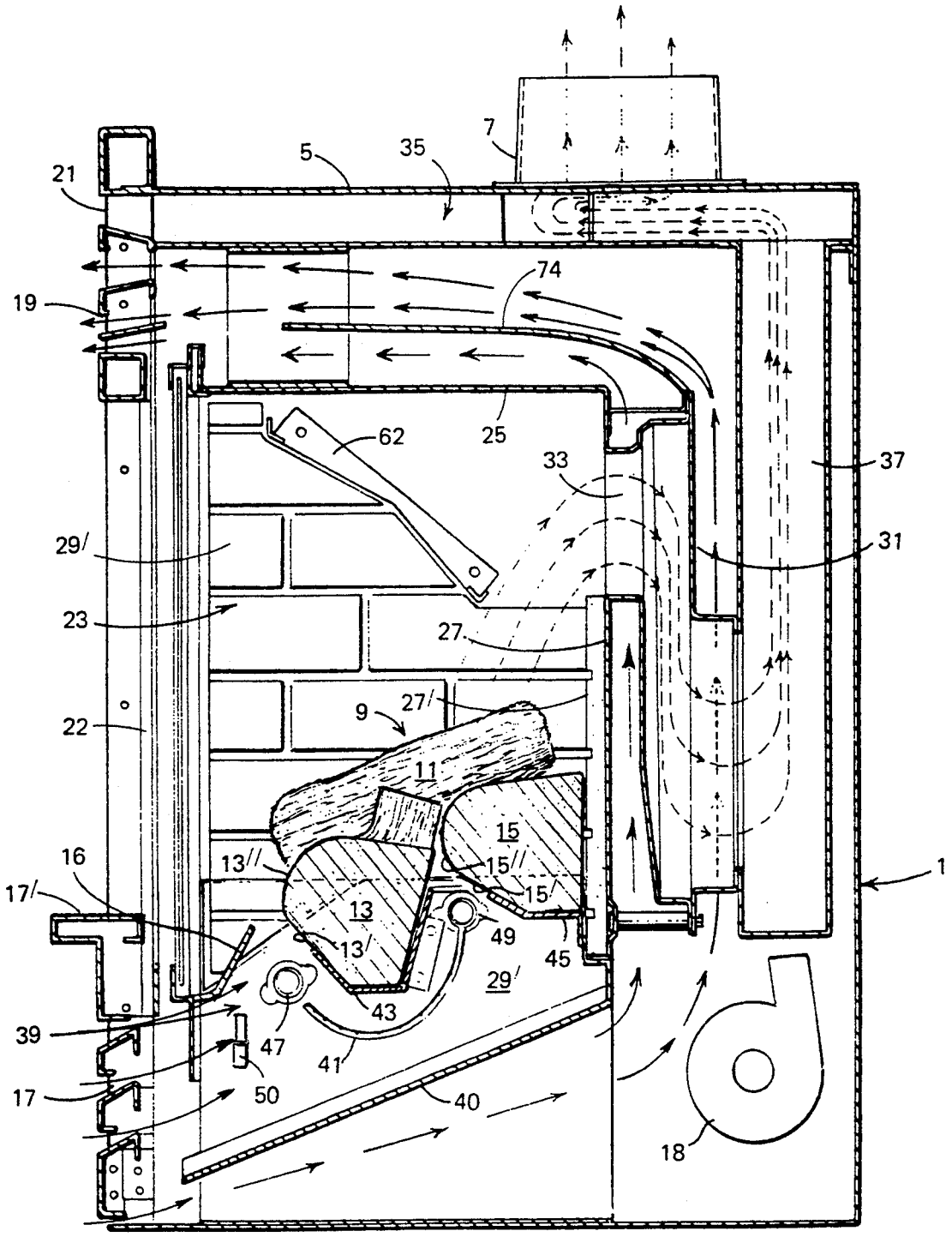
FIG. 2 is a cross sectional view of the fire of FIG. 1.

As best seen in FIGS. 2 and 3 of the accompanying drawings, with the front of the fire removed, there is an inner body 23 located within the main body 1, this inner body being made of metal and having a top 25, rear 27 and sides 29 which define the fuel bed and combustion space of the completed fire. The sides 29 and the rear face 27 of the completed fire are covered by ceramic side cheeks 29' and a ceramic rear cheek 27' which simulate the visual appearance of brickwork. Besides improving the visual appeal of the fire they also prevent flame impingement on the metal inner body 23. Between the inner body 23 and the main body 1 is a volume which defines a passage for convection air between inlet 17 and outlet 19. As seen from FIG. 2 a heat exchanger 31 is located in this volume between the rear 27 of the inner body and the rear of the main body 1. This heat exchanger 31 connects with the region above the fuel bed 9 in said inner body 23 via ports 33 in the upper part of the rear 27 of the the inner body 23, and with a down draught diverter 35 at the top of the fire via a vertical passage 37.

Figure 5:
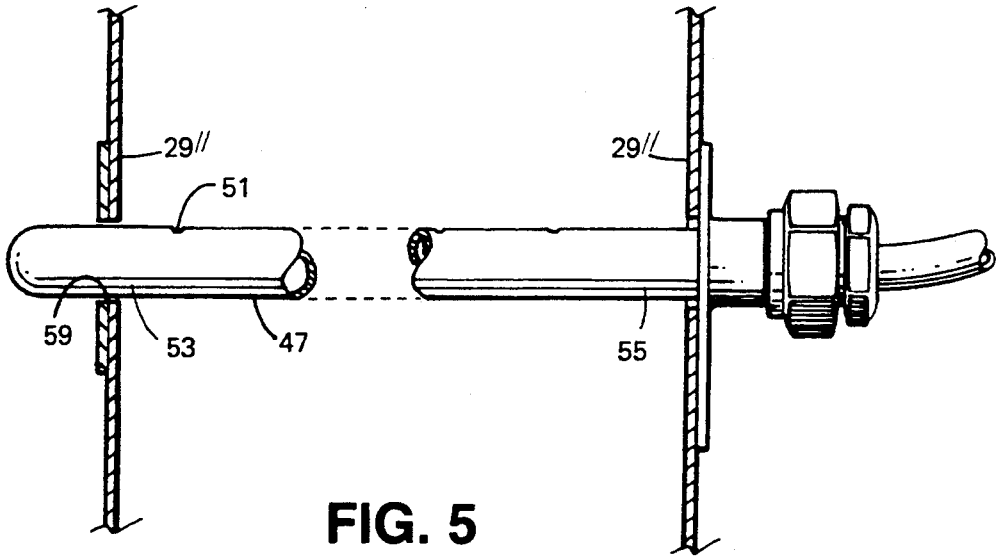
FIG. 5 is an enlarged schematic view illustrating how the burners are supported in the burner module.

As evident from FIG. 3, the lower part of the the inner body 23 mates with a burner module 39 which is separable from the the inner body 23 to facilitate manufacture, repair and/or service. The burner module 39 has sides 29' and a base 40, each side 29' having brackets 43 and 45 (see FIG. 2) for supporting the end regions of the respective simulated logs 13 and 15. Two burners 47,49 are also carried between the sides 29' substantially parallel to said elongate logs and the base 40 is angled rearwardly upwardly to optimise air entrainment from the grill 17 to the burners 47, 49 above the base 40, and the throughflow of convection air below the base 40. Each burner 47,49 basically comprises a hollow elongate rod with an elongate array of burner ports 51 along the major part of its length. One end region 53 of the hollow elongate burner 47,49 is blanked off and the other end region 55 is connected to gas supply controls 57 which are, in use, connected to a gas supply. As shown in FIG. 5, the one end region 53 of each elongate burner 47,49 is freely axially slidably located in an aperture 59 in a side 29'' of the burner module 39, with the said other end region 55 being bolted in position to the other side 29''. Thus manufacturing tolerances regarding the length of the burners 47,49 are not critical, and longitudinal expansion due to heat is not a problem, the burners merely moving in the apertures 59. Aeration holes (not shown) are provided in burners 47 and 49 in end regions 55, with adjustable collars (not shown) being provided to allow for variable aeration to take account of differing types of gases. A cross lighting burner 41 extends forwardly from rear burner 49 to a position adjacent to the front burner 47, so that the rear burner 49 can be lit from the front burner 47 which is ignited initially by the pilot 50.

The two burners 47,49 are positioned so that with the simulated logs 13,15 supported on the brackets 43 and 45, one burner 47 is located in front of the two logs 13,15 with a metal air guide member 16 obscuring the burner 47 from view from the front of the fire, the burner 47 being located in front of and below the level of the major portion of the front log 13 so that flames from burner 47 impinge on and lick around primarily the front region of the front log 13. The rearmost burner 49 is located to the rear of the front log 13 so that the front log obscures the rearmost burner 49 from view from the front of the fire, and in front of and below the major portion of the rearmost log 15 so that flames from the burner 49 impinge on and lick around primarily the front region of the rearmost log 15. In this way the majority of the heat absorbed by the logs 13,15 is radiated out of the front of the fire enhancing the efficiency of the fire. Also, the flames extend upwards between the logs 13,15 and around log 11, to enhance the realism of the fire.

Figure 2A:
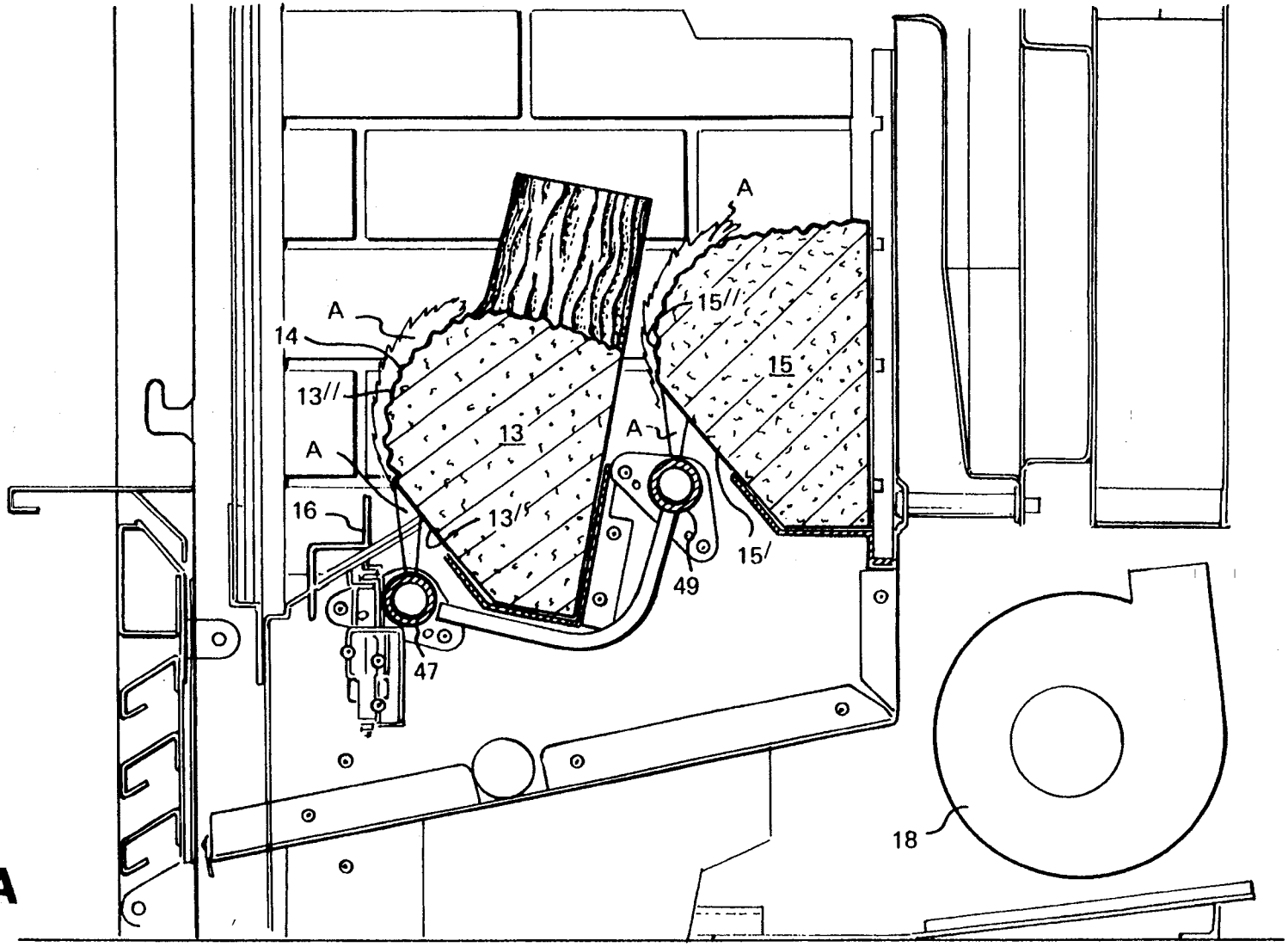
FIG. 2A is a cross-sectional view taken in the middle of the fire, showing only part of the fire and the path of a flame towards and around the simulated solid fuel elements.
Figure 4:
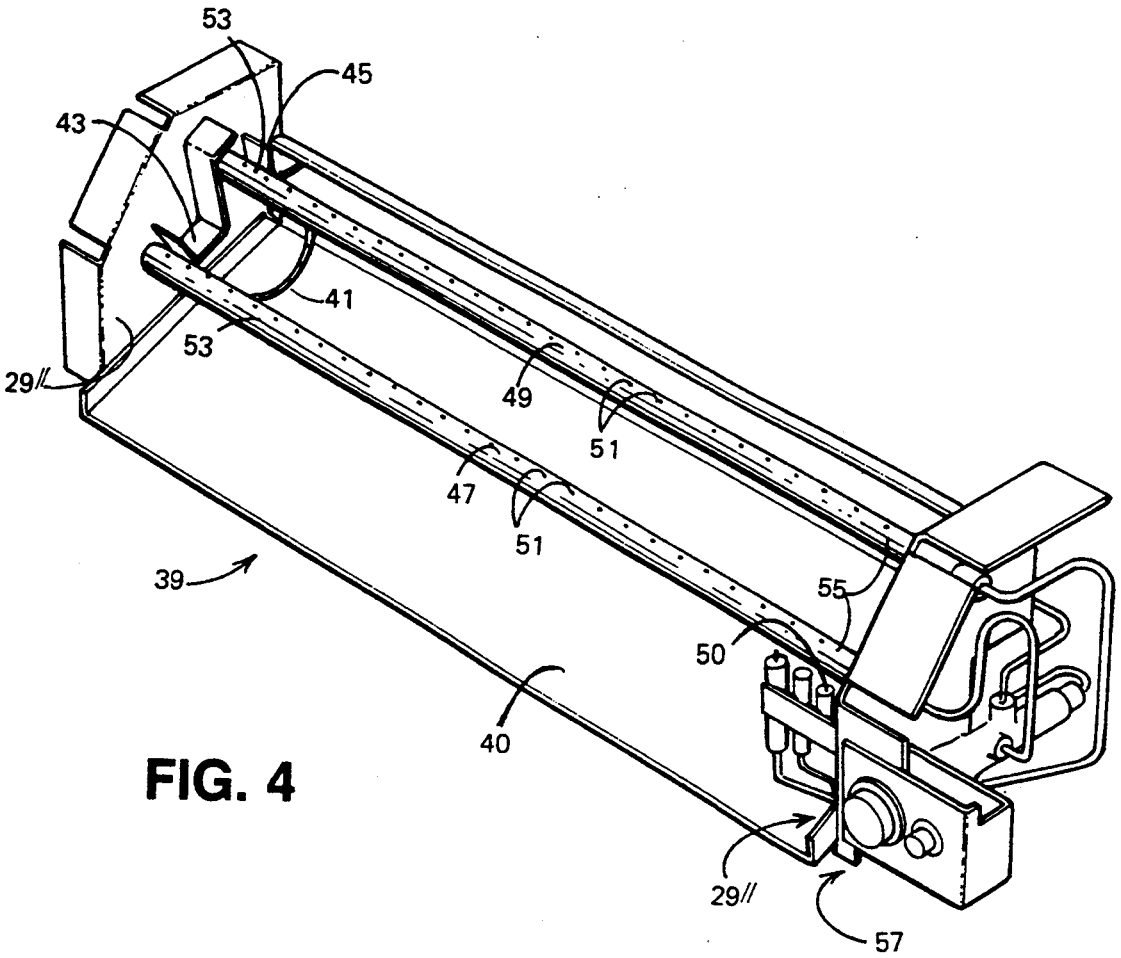
FIG. 4 is a perspective view of the burner module of FIG. 3.

The above describes the apparent visual and heating effect. However the actual operation of the construction of the present invention will now be described in more detail with reference to FIGS. 2 and 2A, of the accompanying drawings. As will be apparent from both FIG. 2 and FIG. 2A, both the lower front portion 13' of the front log 13 and the lower front portion 15' of the rear log 15, are planar and the respective burners 47,49 are arranged to direct their flames A against these planar surfaces 13', 15' which are angled to the flames A. Whilst these angled planar surfaces are preferred, the lower front portions of the simulated fuel elements can alternatively have any other desired configuration. Localised linear heating of these planar sections 13',15' thus occurs and this induces secondary combustion which improves the heating of the simulated solid fuel elements 13, 15 and thus the radiant output after the initial warm up period, secondary air for this secondary combustion being introduced from around the burners 47, 49 and below the simulated solid fuel element 13, 15. The localised heating created by the secondary combustion causes the partially combusted gases to accelerate upwardly in front of and around the front portions 13'', 15'' of the simulated solid fuel elements 13, 15, which front portions 13'', 15'' are preferably curved. By limiting the available space in the region of the lower front portion 13', 15' of the simulated solid fuel elements the supply of secondary air is regulated to ensure that tertiary combustion i.e. complete combustion, occurs in front of the curved section 13'', 15'' of the simulated solid fuel element 13, 15, resulting in yellow flames. The regulated supply of secondary air combining with the upwards acceleration of hot gases result in the yellow flame tertiary combustion assuming the dancing flame effect of a real solid fuel fire. Regulated secondary air supply is ensured by the air guide member 16 located in front of the front simulated solid fuel element 13 and made of metal or a ceramic material, and by the the front simulated solid fuel element 13 located in front of the rear burner 49. Further, by designing the burner as an elongate member with a relatively small transverse cross section, this burner design can also be a contributing factor in obtaining the desired air flow.

To enhance the radiant heat effect, protruding nodules 14 which take the form of a bark pattern, are preferably provided on the curved upper front sections 13'' and 15'' of the simulated solid fuel element 13, 15. These nodules 14 are impinged upon by the upwardly moving hot gases so that they are heated and glow red to give further radiant heat and add to the visual effect.

The construction of the present invention thus provides a simulated solid fuel element fire wherein a partially aerated burner 47, 49 both heats the lower front portion of a simulated solid fuel element to provide for forwardly directed radiant heat at a maximised level due to secondary combustion, and provides realistic yellow dancing flames, the radiant glow at the lower front portion of the simulated fuel element together with the yellow dancing flames providing a very realistic simulation of an actual solid fuel fire. Also, the nodules 14 are heated to red heat to enhance both the forwardly directed radiant heat and the visual effect.

The present invention thus allows efficient heat output at a comfortable level in conjunction with the visual appeal of a solid fuel fire, efficient combustion across a range of input settings allowing a user to enjoy a variety of heat outputs, as desired, and visual appeal. As a result of this construction the formation of undesirable carbon normally associated with gas appliances attempting to replicate solid fuel burning is eliminated. Further NOX (Nitric oxide —No, and Nitrogen Dioxide $NO_2$) emissions are at levels far lower than are normal for a gas heating appliance.

As previously mentioned, the region above the simulated fuel bed 9 connects with a heat exchanger 31 via ports 33 in the upper part of the rear 27 of the inner body 23, and to both enhance performance in respect of the transfer of combustion gases from the burners 47,49 to the heat exchanger 31 and eventually a flue, a heat deflector 61 is provided in the upper part of the front region of the inner body 23. This heat deflector 61 is basically a generally rectangular member formed of two planar sections 61', 61'' which are angled with respect to each other, the deflector 61 resting on brackets 62 provided on the sides 29 of the inner body 23, this deflector extending across the fire and being angled downwardly from the front towards the rear of the fire. This deflector 61 is positioned in front of the ports 33 and thus obscures the ports 33 from view from the front of the fire, thereby enhancing the aesthetics of the fire in general. Regarding performance, this deflector 61 tends to cause a build-up of combustion gases at the rear of the upper part of the inner body 23, effectively forcing the gases into the ports 33. Also, gases flow around the deflector 61 and turbulence is reduced. This can be enhanced by constructing the deflector 61 as a black body which readily absorbs heat. The deflector 61 then also acts as an efficient source of radiant heat, adding to the heating efficiency of the fire. Alternatively the deflector 61 can be reflective if desired.

Figure 6:
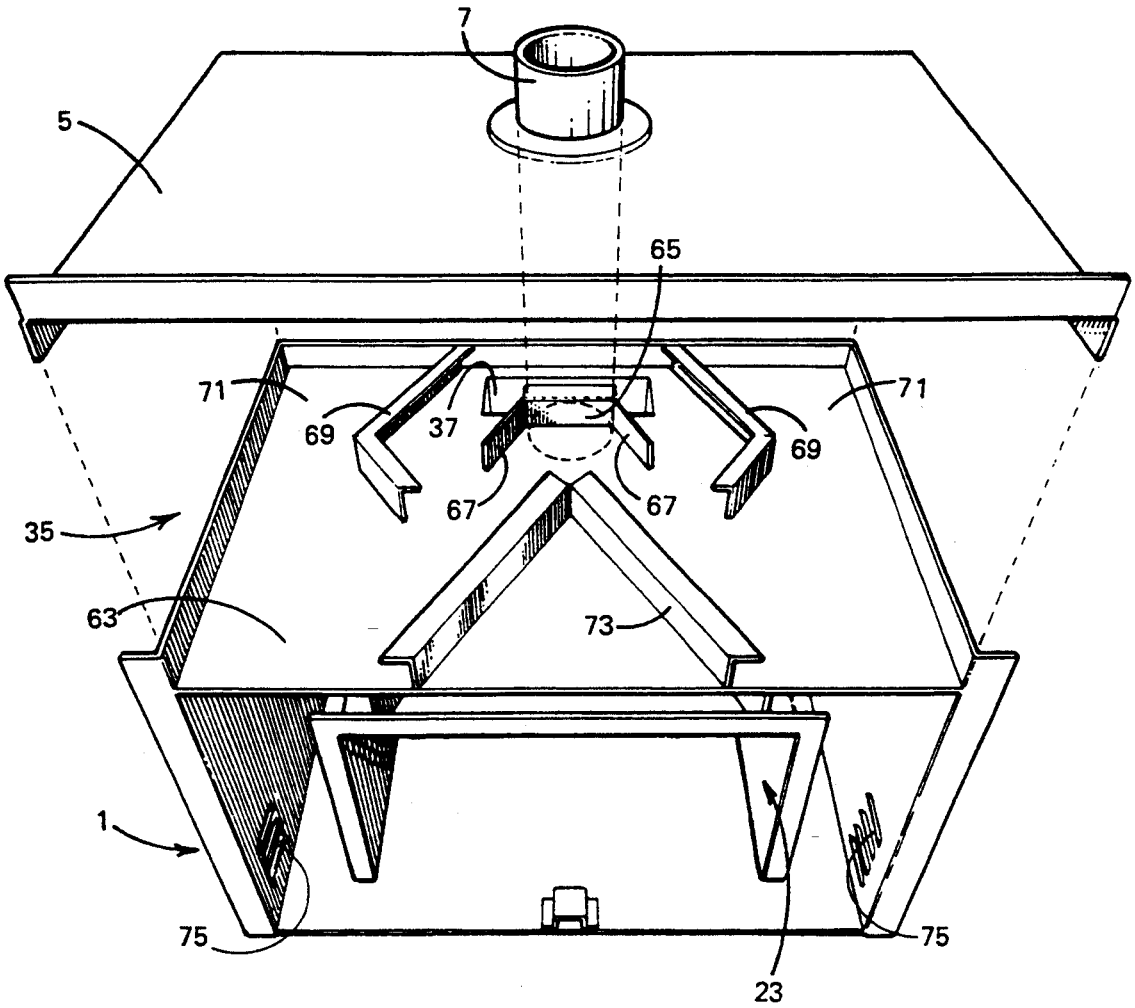
FIG. 6 is a perspective view of the upper part of the fire of FIGS. 1 to 5, with the top removed to show the construction of the down draught diverter.

Combustion gases pass via ports 33 to the heat exchanger 31 which incorporates a number of internal baffles, (not shown) the heat exchanger 31 connecting with the down draught diverter 35 via the vertical passage 37. This down draught diverter, as seen from FIGS. 2 and 6, comprises a chamber 63 at the top of the fire. The chamber 63 extends across the whole area of the top of the main body 1 of the fire and is small in height as compared to its area. The vertical passage 37 opens into the chamber 63 at the middle of the rear of the chamber 63 and immediately in front of the passage 37 in the chamber 63 is a wall 65 which is generally U-shaped in plan, the flue spigot 7 connecting with the chamber 63 through the upper wall of the chamber, i.e. the top wall of the complete fire, in the region between the arms 67 of the U-shaped wall 65. Further, angled walls 69, i.e. generally L-shaped walls in plan, are located in said chamber 63 on either the of said generally U-shaped wall to deflect combustion gases issuing from the passage 37 and passing around the generally U-shaped wall 65, back towards the centre of the chamber 63 and thus towards a flue connected to the flue spigot 7. These angled walls 69 enhance the through flow of gases to the flue spigot 7, reducing the possibility of pockets of combusted gas collecting in the corner regions 71 of the chamber 63. A further guide wall 73 is located in the middle of the front of the chamber 63 to reduce the chances of any combustion gases issuing through the diverter outlet 21 during normal operation of the fire. Alternatively the guide wall 73 can be omitted with the middle region of the diverter outlet 21 being closed to reduce the front discharge area whilst retaining the back depth of chamber 63. Gases can, of course, escape through diverter outlet 21 in the event of a down draught or blockage in the flue.

Part of the air is drawn in through inlet grid 17 which passes beneath the base 40 of the burner module 39 and forms a flow of convection air. This flow of convection air flows over the heat exchanger 31 and is thus heated, the resultant hot air being divided into two air flows by a splitter plate 74 which extends generally horizontally over part of the top of the inner body 23 towards the outlet grid 19. This splitter plate 74 serves as a heat shield restricting the amount of heat to be transferred from the inner body 23 to the upper region of the fire.

The fire of the present invention can be located in a conventional fireplace opening constructed from masonry. Alternatively the fire can be located in a wooden studded enclosure when an additional metal baffle kit (not shown) is fitted to the outer body 1. To ensure that the temperature of this additional baffling remains within the required temperature limits, slots 75 are provided in the lower region of the side panels 3. These slots 75 allow cooling air to be drawn through the outer regions of inlet grid 17, and into the baffle arrangement to vent out of an aperture above the front of the fire. Slots 75 are either not provided or have cover plates when the fire is used in other situations. As an alternative to slots 75 an opening of any desired configuration can be provided.

The present invention thus provides a simple but efficient and aesthetically pleasing, simulated solid fuel effect gas fire, wherein a number of advantageous features can be incorporated both to improve performance and to facilitate manufacture, repair and service.

We claim:

1. A simulated solid fuel effect gas fired heater having a front and a top region across the front, the heater comprising, a first simulated solid fuel element located within a body of the gas fired heater and having a top, a bottom, a front and a rear, the first simulated solid fuel element having a first partially aerated gas burner arranged in front of and below the first simulated solid fuel element with respect to the front of the heater, so that, in use the flames from the burner engage a lower front portion of the front of the first simulated solid fuel element, the flames then passing around the front of the first simulated solid fuel element, a port in a wall of the body of the heater for conveying away combustion products from the burner, the port leading to a flue via a down draught diverter located on top of the heater, the down draught diverter comprising a chamber having a front and a rear, the chamber having an elongate slot formed in the top region across the front of the heater, a vertical passage to the rear of the chamber connecting with said port, and a U-shaped wall having two horizontally extending arms, being located in the chamber in front of said passage with the flue connecting with the chamber through an upper wall of the chamber between the arms of said U-shaped wall.

2. A gas fired heater according to claim 1, wherein angled walls are located in said chamber on either side of said generally U-shaped wall to deflect combustion gases issuing from said vertical passage and passing around the U-shaped wall, back towards a center of the chamber.

3. A gas fired heater according to claim 2 wherein the angled walls are L-shaped in plan.

4. A gas fired heater according to claim 1, wherein a guide wall is provided in the chamber in a middle of a front region of the chamber.

5. A gas fired heater according to claim 1, wherein a lower front portion of the first simulated solid fuel element is a planar surface and angled relative to the first burner so that in use, the flames impinge on the planar surface at an angle to said planar surface.

6. A gas fired heater according to claim 1, wherein the front of the first simulated solid fuel element includes small protrusions.

7. A gas fired heater according to claim 1, further comprising a second partially aerated burner, said first and second burners being located substantially parallel to each other at spaced apart locations with the second burner located to a rear of the first burner with respect to the front of the heater and located higher than the first burner with respect to a bottom of the heater.

8. A gas fired heater according to claim 7, further comprising a second simulated solid fuel element, wherein the first and second simulated solid fuel elements in the form of elongate logs are supported substantially parallel to each other and to the first and second elongate burners, with the first solid fuel element being supported between the first and second burners with respect to the front of the heater and the second solid fuel element being supported to the rear of the second burner with respect to the front of the heater, the first and second simulated solid fuel elements being arranged step-wise so that the second burner is obscured from view by the first simulated solid fuel element when viewed from the front of the heater.

9. A gas fired heater according to claim 8, wherein an air guide member is located in front of the first simulated solid fuel element with respect to the front of the heater, obscuring the first burner when viewed from the front of the heater.

10. A gas fired heater according to claim 8, wherein the first and second elongate burners are a burner module, the module forming a separable part of the heater.

11. A gas fired heater according to claim 7, wherein the first and second burners are each supported in a cantilever fashion by the heater, each burner having a first end region and a second end region, the first end region of each burner being fixedly supported on the heater and connected to a gas/air mix supply, with the second end region of each burner being a freely axially slidable fit in an aperture provided in the heater.

12. A gas fired heater according to claim 1, wherein an angled heat deflector is located above the first simulated solid fuel element with respect to the front of the heater, the heat deflector being a generally rectangular member formed by two planar sections angled with respect to each other and located across the top of the heater and angled downwardly from their front to rear edges with respect to the front of the heater.

13. A gas fired heater according to claim 12, wherein the angled heat deflector is located in front of a port which leads to a convection air heat exchanger before connecting with the flue.

14. A gas fired heater according to claim 12, wherein the angled heat deflector is a black body.

15. A gas fired heater according to claim 12, wherein the angled heat deflector is reflective.

16. A gas fired heater according to claim 1, wherein the front of the heater is closed by a transparent plate and openings are provided in sides of the heater for allowing cool convection air to enter.

17. A simulated solid fuel effect gas fired heater having a front and rear, the heater comprising, a first and a second simulated solid fuel element, each simulated solid fuel element being in the form of an elongate log and having a top, bottom, front and rear, and a first and a second partially aerated elongate gas burners, wherein each partially aerated elongate gas burner is respectively arranged in front of and below each simulated solid fuel element with respect to the front of the heater, so that, in use the flames from the first and second elongate burners engage a lower front portion of the first and second simulated solid fuel elements, respectively, the flames then passing around the front of each of the simulated solid fuel elements, the first and second elongate burners being part of a burner module forming a separable part of the heater, with the first and second elongate burners being located substantially parallel to each other at spaced apart locations with the second burner located to the rear and above the first burner with respect to the front and a bottom of the heater, respectively, the first and second elongate burners being connected to a gas/air mix supply and being supported in a cantilever fashion, each burner having a first end region and a second end region, the first end region of each burner being fixedly supported on the side of the heater with the second end region of each burner being a freely axially slidable fit in the module, the first and second simulated solid fuel elements being supported substantially parallel to each other and to the first and second elongate burners, with the first simulated solid fuel element being supported between the first and second elongate burners with respect to the front of the heater and the second simulated solid fuel element being supported to the rear of the second burner with respect to the front of the heater, the first and second simulated solid fuel elements being arranged step-wise so that the second burner is obscured by the first simulated solid fuel element when viewed from the front of the heater.

18. A gas fired heater according to claim 17, wherein a lower front portion of the each of the first and second simulated solid fuel element is a planar surface and angled relative to the first and second burners, respectively, so that in use, the flames from the burners respectively impinge on each planar surface at an angle to the each planar surface.

19. A gas fired heater according to claim 17, wherein the front of a simulated solid fuel element includes small protrusions.

20. A gas fired heater according to claim 17, wherein an air guide member is located in front of the first simulated solid fuel element with respect to the front of the heater, obscuring the first burner from view when viewed from the front of the heater.

21. A gas fired heater according to claim 17, wherein an angled heat deflector is located above the first and second simulated solid fuel elements with respect to the bottom of the heater, the heat deflector being a generally rectangular member formed by two planar sections angled with respect to each other and located across the top of the heater and angled downwardly from their front to rear edges with respect to the front of the heater.

22. A gas fired heater according to claim 21, wherein the angled heat deflector is located in front of a port which leads to a convection air heat exchanger before connecting with a flue.

23. A gas fired heater according to claim 21, wherein the angled heat deflector is a black body.

24. A gas fired heater according to claim 21, wherein the angled heat deflector is reflective.

25. A gas fired heater according to claim 17, wherein a port for conveying combustion products from the burner leads to a flue via a down draught diverter located on top of the heater, the down draught diverter comprising a chamber having an elongate slot located across a top region of the front of the heater, a vertical passage to a rear of the chamber connecting with said port, a wall which is generally U-shaped in plan and having two horizontally extending arms, being located in the chamber in front of said passage, with the flue connecting with the chamber through an upper wall of the chamber between the arms of said U-shaped wall.

26. A gas fired heater according to claim 25, wherein a guide wall is provided in the chamber in a middle of a front region of the chamber.

27. A gas fired heater according to claim 26, wherein the front of the heater is closed by a transparent plate and openings are provided in sides of the heater for allowing cool convection air to enter.

28. A gas fired heater according to claim 26, wherein angled walls are located in said chamber on either side of said generally U-shaped wall to deflect combustion gases issuing from said vertical passage and passing around the U-shaped wall, back towards a center of the chamber.

29. A gas fired heater according to claim 28, wherein the angled walls are L-shaped in plan.

30. A gas fired heater according to claim 17, wherein the first end region of each burner is connected to the gas/air mix supply and the second end of each burner is freely slidably fit on an aperture provided in the heater.

* * * * *